US006042422A

United States Patent [19]

Youtsey

[11] Patent Number: 6,042,422

[45] Date of Patent: Mar. 28, 2000

[54] COAXIAL CABLE END CONNECTOR CRIMPED BY AXIAL COMPRESSION

[75] Inventor: Timothy L. Youtsey, Mesa, Ariz.

[73] Assignee: PCT-Phoenix Communication Technologies-USA, Inc., Gilbert, Ariz.

[21] Appl. No.: 09/168,167

[22] Filed: Oct. 8, 1998

[51] Int. Cl.[7] ..... H01R 9/05; H01R 17/04

[52] U.S. Cl. ..... 439/585

[58] Field of Search ..... 439/585, 578, 439/877

[56] References Cited

U.S. PATENT DOCUMENTS

| | | | |
|---|---|---|---|
| 3,517,375 | 6/1970 | Mancini . | |
| 4,400,050 | 8/1983 | Hayward . | |
| 4,684,201 | 8/1987 | Hutter . | |
| 4,755,152 | 7/1988 | Elliot et al. | 439/452 |
| 4,990,106 | 2/1991 | Szegda . | |
| 5,073,129 | 12/1991 | Szegda | 439/585 |
| 5,147,221 | 9/1992 | Cull et al. | 439/585 |
| 5,217,393 | 6/1993 | Del Negro et al. . | |
| 5,525,076 | 6/1996 | Down . | |
| 5,660,565 | 8/1997 | Williams . | |
| 5,860,833 | 1/1999 | Chillscyzn et al. | 439/585 |
| 5,882,233 | 3/1999 | Idehara | 439/877 |

*Primary Examiner*—Renee S. Luebke
*Assistant Examiner*—Chaudrika Prasad
*Attorney, Agent, or Firm*—Richard C. Litman

[57] ABSTRACT

A coaxial cable end connecter includes an outer barrel, an inner tube, and a female receptacle. The connector is fixed to a coaxial cable by axial compression of the outer barrel which has collapsible bands. The collapsible bands have a shallow V-shaped cross section and are bracketed by undercut surfaces. These structural features ensure that the collapsible bands will fold without cracking or leaving gaps between the non-collapsible portions of the outer barrel.

15 Claims, 3 Drawing Sheets

COAXIAL CABLE END CONNECTOR CRIMPED BY AXIAL COMPRESSION

BACKGROUND OF THE INVENTION

1. Field of the Invention

The present invention relates to a connector for connecting an end of a coaxial cable to another coaxial cable.

2. Description of the Related Art

Coaxial cable are commonly used in the cable television industry to carry cable T.V. signals to television sets in homes, businesses, and other locations. It is common practice to use a female connector crimped to the end of the coaxial cable to interface the cable with a T.V. set or other coaxial cables. In addition, coaxial cables are used in the computer industry to create local area networks. The coaxial cable connectors in common use employ radial compression crimping which does not apply compressive force evenly to the outer tubular jacket of the connector, thus leaving channels for the infiltration of moisture into the coaxial cable connection and consequently leading to the degradation of the signal carried by the cable.

U.S. Pat. No. 5,660,565, issued to M. Deborah Williams on Aug. 26, 1997, U.S. Pat. No. 55,217,393, issued to James J. Del Negro et al. on Jun. 8, 1993, U.S. Pat. No. 4,990,106 issued to Andrew Szegda on Feb. 5, 1991, U.S. Pat. No. 4,684,201, issued to Harold G. Hutter on Aug. 4, 1987, and U.S. Pat. No. 4,400,050, issued to Robert D. Heyward on Aug. 23, 1983, are examples of coaxial cable connectors that use radial compression crimping.

U.S. Pat. No. 3,517,375, issued to LLoyd Mancini on Jun. 23, 1970, shows an axially compressible terminal contact that pinches the outer conductor of a coaxial cable to form a conductive contact therewith. Regions of the terminal contact of Mancini collapse outward. The Mancini patent does not show an outer barrel with inward collapsing regions.

U.S. Pat. No. 5,525,076, issued to William J. Down on Jun. 11, 1996, shows a coaxial cable connector that is crimped to the end of the coaxial cable by axial compression of an outer tubular member. However, as is evident from the Figures in the Down patent, the collapsible portions of the outer tubular member connector are not shaped to eliminate gaps and cracks in the collapsible portions.

None of the above inventions and patents, taken either singularly or in combination, is seen to describe the instant invention as claimed. In particular, none of the above inventions and patents show the shallow V-shaped cross section of the collapsible portions of the outer barrel of the connector of the present invention. Nor do any of the above inventions and patents show the undercut surfaces bracketing the collapsible portions of the outer barrel of the connector of the present invention. In addition, none disclose the use of o-rings for sealing a coaxial connector from moisture.

SUMMARY OF THE INVENTION

The present invention is directed to a coaxial cable end connecter including an outer barrel, an inner tube, and a female receptacle. The connector is fixed to a coaxial cable by axial compression of the outer barrel which has collapsible bands. The collapsible bands have a shallow V-shaped cross section and are bracketed by undercut surfaces. These structural features ensure that the collapsible bands will fold without cracking or leaving gaps between the non-collapsible portions of the outer barrel.

Accordingly, it is a principal object of the invention to provide a connector for a coaxial cable that is fixed to the end of the coaxial cable by axial compression of an outer barrel of the connector.

It is another object of the invention to provide a connector for a coaxial cable that has collapsible regions which will fold without cracking or leaving gaps in the outer barrel of the connector.

It is a further object of the invention to provide a connector for a coaxial cable that has collapsible regions having a shallow V-shaped cross section and bracketed by undercut surfaces.

Still another object of the invention is to provide a connector for a coaxial cable that can seal the conductive pathways against moisture.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
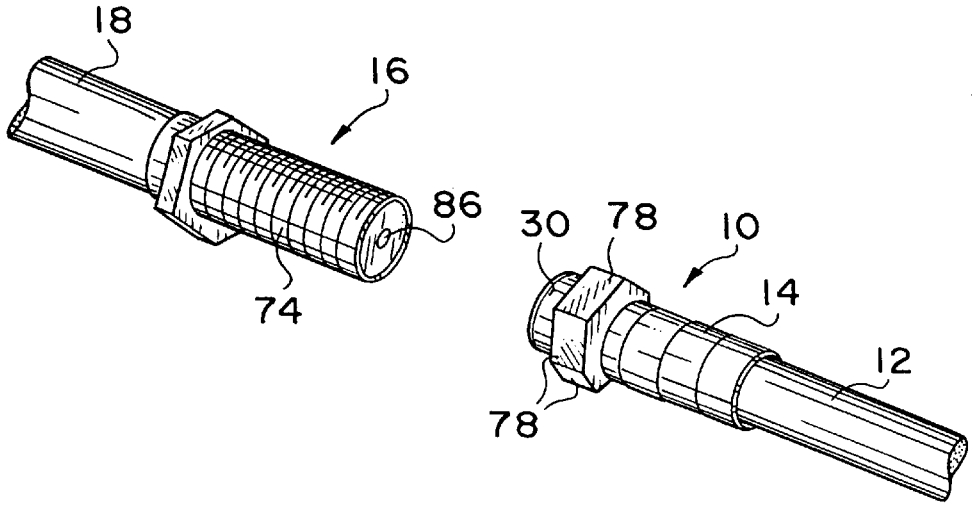
FIG. 1 is an environmental view of a female coaxial cable connector using the axially compressible outer barrel of the present invention.
Figure 2:
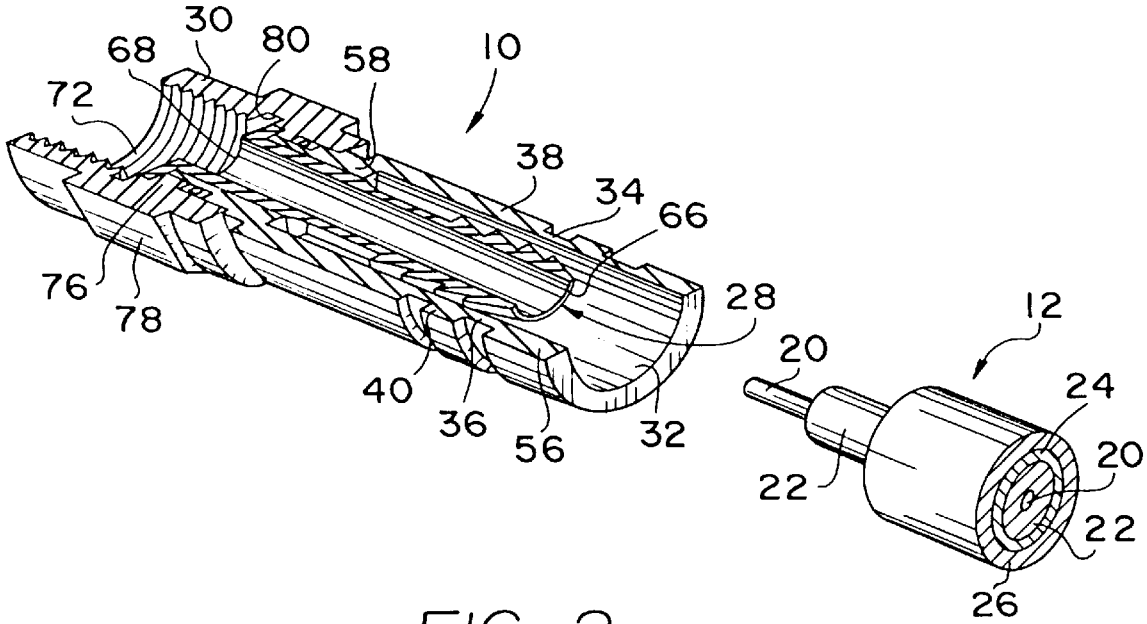
FIG. 2 is a cutaway perspective view showing internal details of a female coaxial cable connector using the axially compressible outer barrel of the present invention.
Figure 3:
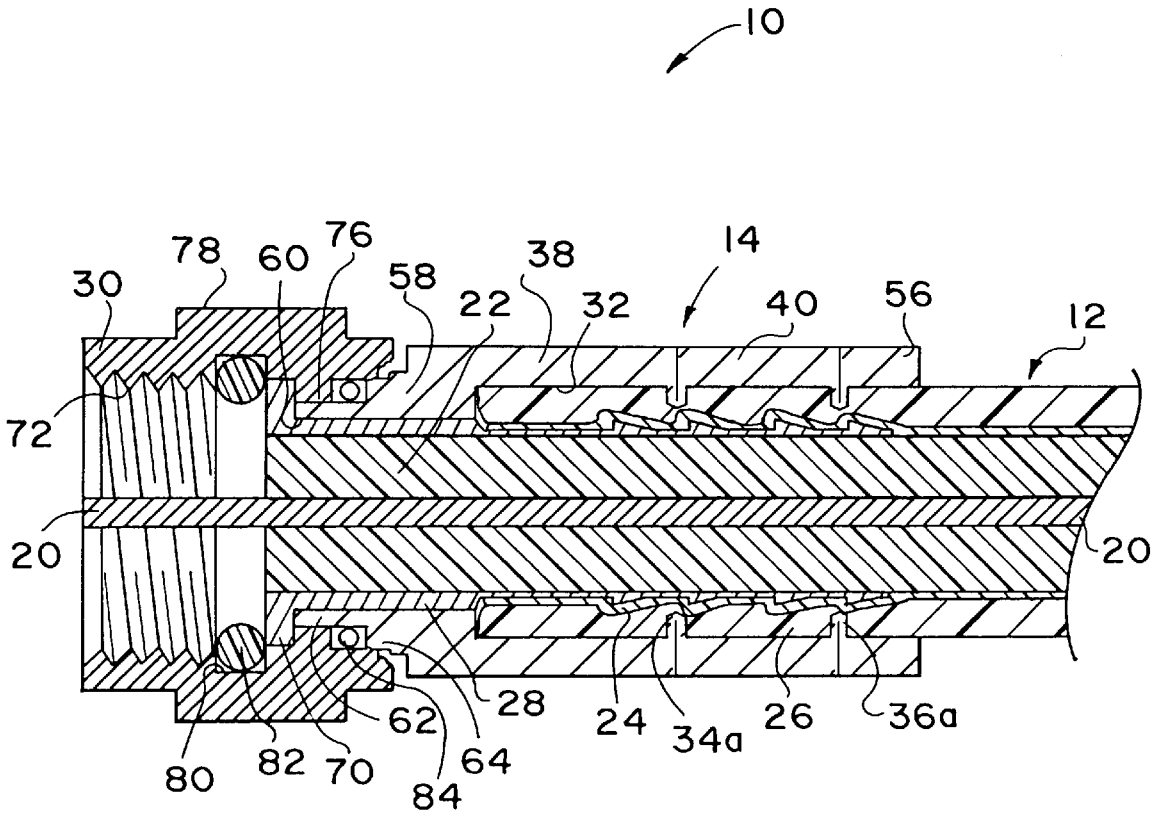
FIG. 3 is a cross sectional view of a female coaxial cable connector using the axially compressible outer barrel of the present invention, shown after axial compression.

Referring to FIG. 1, the present invention is directed to a coaxial cable end connector 10 which is secured or crimped to the end of a coaxial cable 12 by axial compression or axial collapse of an outer barrel 14. Although in the accompanying illustrations the axially collapsible barrel 14 is shown in the context of a female coaxial cable connector, the axially collapsible barrel 14 is equally applicable to securing male connectors such a: male connector 16 to the end of a coaxial cable such as cables 12 or 18. The connector 10 as shown in the accompanying illustrations can be modified such that the collapsible outer barrel 14 can be used to secure a male connector to a coaxial cable.

Referring to FIGS. 1, 2, 3, and 4, a coaxial cable end connector 10 incorporating the collapsible outer barrel 14 can be seen. The coaxial cable end connector 10 is for use with a coaxial cable 12 which is of a type commonly used in the cable television industry. The coaxial cable 12 has a central conductor 20, an inner insulation layer 22, an outer conductor 24, and an outer insulation layer 26.

The coaxial cable end connector 10 includes an outer barrel 14, an inner tube 28, and female receptacle 30. The outer barrel 14 has a bore 32 and a longitudinal axis coincident with the longitudinal axis of the central conductor 20, such that the outer barrel 14 is roughly in the shape of a tubular shell or wall having portions with different functions. The wall of the outer barrel 14 has two collapsible bands 34 and 36. In the most preferred embodiment two collapsible bands are used however only one collapsible band would be sufficient to make a functional device. The collapsible band 34 extends between a first non-collapsible wall portion 38 and a second non-collapsible wall portion 40. As the name implies, the non-collapsible wall portions are made relatively thick such that they will not deform as the outer barrel 14 is being compressed.

The collapsible band 36 is identical to the collapsible band 34, therefore only the collapsible band 34 will be discussed in detail. However, all comments made in reference to the collapsible band 34 are equally applicable to the collapsible band 36. The collapsible band 34 has an inner side 42 facing toward the longitudinal axis of the outer barrel 14. The collapsible band 34 also has an outer side 44 facing away from the longitudinal axis of the outer barrel 14. The collapsible band 34 has a bend 46 about midway between the first non-collapsible wall portion 38 and the second non-collapsible wall portion 40 when viewed in cross section, such that the outer side 44 of the collapsible band 34 is concave and the inner side 42 of the collapsible band 34 is convex.

The collapsible band 34 has a first portion 48 extending between the bend 46 and the first non-collapsible wall portion 38. Also, the collapsible band 34 has a second portion 50 extending between the bend 46 and the second non-collapsible wall portion 40.

Figure 4:
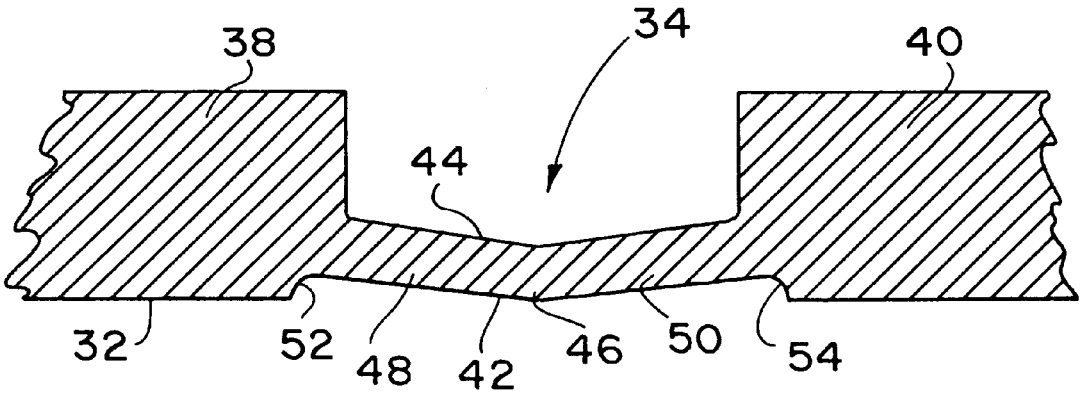
FIG. 4 is a fragmentary detail view of the collapsible portions of the axially compressible outer barrel of the present invention.

As is apparent from FIG. 4, the collapsible band 34 will have a shallow V-shaped cross section such that the first portion 48 of the collapsible band 34 and the second portion 50 of the collapsible band 34 form an obtuse angle on the outer side 44 of the collapsible band 34, prior to compression of the outer barrel 14. Also, the collapsible band 34 will have an essentially constant thickness. The terms "essentially constant" as used herein is intended to allow for slight thickening of the collapsible band 34 at the bend 46 and at the fillets at the attachment of the collapsible band 34 to the non-collapsible wall portions 38 and 40. These terms also take into account the error tolerances inherent in the fabrication of any part.

The minimum inner radius of the bore 32 of the outer barrel 14, except for the portion of the barrel 14 adjacent the female receptacle 30, is defined by the inner radii of the non-collapsible wall portions adjacent the collapsible bands 34 and 36; the inner radii of the non-collapsible wall portions adjacent the collapsible bands 34 and 36 being equal. It is important that the apex of the bend 46 not project inward beyond the inner radii of the non-collapsible wall portions adjacent the collapsible bands 34 and 36. This feature allows the unimpeded insertion of the coaxial cable 12 into the end connector 10 prior to the axial compression of the outer barrel 14. Therefore, the inner side 42 of the collapsible band 34 meets the non-collapsible wall portions 38 and 40 at locations that are radially spaced farther from the longitudinal axis of the outer barrel 14 than the inner radii of the non-collapsible wall portions 38 and 40.

Further, the non-collapsible wall portions 38 and 40 are undercut adjacent the collapsible band 34, forming the undercut surfaces 52 and 54. The first undercut surface 52 forms a concavity which faces toward the longitudinal axis of the outer barrel 14 and extends axially away from the second non-collapsible wall portion 40, when viewed in cross section. The undercut surface 52 begins at the location where the inner side 42 of the collapsible band 34 meets the first non-collapsible wall portion 38 Similarly, the second undercut surface 54 forms a concavity which faces toward the longitudinal axis of the outer barrel 14 and extends axially away from the first non-collapsible wall portion 38, when viewed in cross section. The second undercut surface 54 begins at the location where the inner side 42 of the collapsible band 34 meets the second non-collapsible wall portion 40.

The first and second undercut surfaces 52 and 54 allow the collapsible band 34 to axially collapse without cracking and without leaving any gaps between the first and second non-collapsible wall portions 38 and 40, because the undercut surface provide a place for the material of the collapsible band 34, normally a metal, to flow into as the collapsible band 34 folds and collapses; instead of the material of the collapsible region piling up between the non-collapsible wall portions as was the case in the prior art. The elimination of gaps between non-collapsible wall portions has the advantage that the finally assembled connector will have a smooth outer surface on the outer barrel 14, thus eliminating any notches or depressions where the connector 10 can catch on other objects as the cable is routed through tight quarters. Also, the remaining gap allows relative movement between the non-collapsible regions during handling and use, which may result in metal fatigue and consequent cracking which in turn can lead to moisture intrusion into the cable connection and resultant corrosion.

More preferably, the geometry of the collapsible band 34 is such that the inner side 42 of the collapsible band 34 extends from either side of the bend 46 to a greater extent than the outer side 44 of the collapsible band 34. The first undercut surface 52 then extends radially inward and axially away from the second non-collapsible wall portion 40 along an arc having an essentially constant radius of curvature, when viewed in cross section, beginning at the location where the inner side 42 of the collapsible band 34 meets the first non-collapsible wall portion 38. Similarly, the second undercut surface 54 then extends radially inward and axially away from the first non-collapsible wall portion 38 along an arc having an essentially constant radius of curvature, when viewed in cross section, beginning at the location where the inner side 42 of the collapsible band 34 meets the second non-collapsible wall portion 40. As before, the terms "essentially constant radius of curvature" are intended to take into account variations due to the error tolerances inherent in the fabrication of any part.

The geometry and function of the collapsible band 36 is identical to those of the collapsible band 34, except that the collapsible band 36 extends between non-collapsible wall portions 40 and 56. Also, the inner side of the collapsible band 36 is bracketed by a pair of undercut surfaces similar to the undercut surfaces 52 and 54, formed in non-collapsible wall portions 40 and 56. The two collapsible bands 34 and 36 together provide a greater gripping force between the coaxial cable end connector 10 and an end of a coaxial cable 12.

An inner tube 28 is positioned to lie at least in part within the bore of the outer barrel 14. The inner tube 28 is coaxial with the outer barrel 14. The first non-collapsible wall portion 38 has a large interior diameter portion and a small interior diameter portion 58. The small interior diameter portion 58 is located distally from the collapsible band 34 and terminates in an open end 60. The small interior diameter portion 58 has a stepped exterior profile which results in the non-collapsible wall portion 38 having a small exterior diameter portion 62, an intermediate portion 64, and a large exterior diameter portion which forms the greater part of the non-collapsible wall portion 38. The small exterior diameter portion 62 has a first outer radius, and the intermediate portion 64 has a second outer radius that is greater than the first outer radius. As the name implies, the intermediate portion 64 is located intermediate the small exterior diameter portion 62 and the large exterior diameter portion which forms the greater part of the non-collapsible wall portion 38. The interior diameter of the small internal diameter portion 58 is just large enough for the small internal diameter portion 58 to fit around and contact the inner tube 28.

The inner tube 28 has an inlet end 66 and an outlet end 68 located outside the bore of the outer barrel 14 proximate the open end 60. A first flange 70 projects radially outward from said outlet end 68 of the inner tube 28. The flange 70 and abuts the open end 60 of the small exterior diameter portion 62. The first flange 70 has a third outer radius.

The female receptacle 30 has internal threads 72 that are matingly engageable with the male external threads 74 on a male coaxial cable end connector 16. The female receptacle 30 further has a second flange 76 which projects radially inward and has an inner radius smaller than the second outer radius of the intermediate portion 64 and the third outer radius of the flange 70. The second flange 76 being positioned intermediate the first flange 70 and the intermediate portion 64 of the first non-collapsible wall portion 38 to thereby retain the female receptacle 30 as part of the coaxial cable end connector 10 while allowing the female receptacle 30 to rotate freely relative to the outer barrel 14 and the inner tube 28. The female receptacle 30 has hexagonal exterior facets 78 that allow the female receptacle 30 to be turned by a wrench.

The female receptacle 30 also has an internal o-ring groove 80 formed therein intermediate the internal threads 72 and the second flange 76. The o-ring groove 80 is spaced apart from the second flange 76 so as to be positioned on a side of the first flange 70 which is opposite the side of the first flange 70 adjacent the second flange 76.

A first o-ring 82 is positioned within the o-ring groove 80. A second o-ring 84 is positioned around the small exterior diameter portion 62 of the first non-collapsible wall portion 38 and intermediate the second flange 76 and the intermediate portion 64 of the first non-collapsible wall portion 38. The o-rings 82 and 84 seal the interior of the coaxial cable end connector 10 from moisture and other corrosive agents in the ambient environment when the female connector 10 is engaged to the male connector 16. The o-rings 82 and 84 also function to retain the parts of the coaxial cable end connector 10 together until the connecter 10 is fixed to the end of a coax cable by crimping.

In use, the coaxial cable 12 is inserted into the outer barrel 14, such that the central conductor 20 and the inner insulation 22 are inserted into the inner tube 28, and the outer conductor 24 and the outer insulation 26 are positioned intermediate the outer barrel 14 and the inner tube 28. The central conductor 20 is electrically isolated from the parts of the connector 10, however, the outer conductor is electrically connected to the female receptacle 30 via the inner tube 28. A well known crimping tool is used to compress the outer barrel 14, thus causing the collapsible bands 34 and 36 to collapse and form the annular ribs 34*a* and 36*a,* respectively. The annular ribs 34*a* and 36*a* project inward toward the inner tube 28 to thereby fixedly grip the outer conductor 24 and the outer insulation 26 between the outer barrel 14 and the inner tube 28, thus fixing the connector 10 to the coaxial cable 12. The connector 10 can then be matingly engaged to the connector 16 to complete the circuit as is well known. The central conductor 20 is inserted into the hole 86 to contact the central conductor of cable 18. The outer conductor of the cable 18 is in conductive contact with male connector 16, thus, once the connectors 10 and 16 are matingly engaged, the outer conductors of the cables 12 and 18 will be in conductive contact with one another. The outer conductors are usually grounded while the central conductor carry the cable signal.

Figure 5:
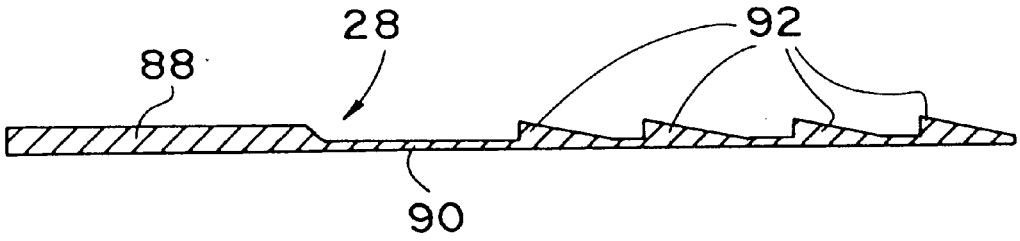
FIG. 5 is a fragmentary detail view of the inner tube, normally inserted between the inner insulating layer and the outer conductor of a coaxial cable, of the coaxial cable end connector of the present invention.

Referring to FIG. 5, details of the construction of the inner tube 28 can be seen. The inner tube 28 is made in one piece and has a thickened portion 88 and a serrated tube portion 90. The thickened portion 88 extends between the first flange 70 and the serrated tube portion 90. The inner tube 28 is made of metal. The serrated tube portion 90 has external serrations 92 to allow the connector 10 to better grip the cable 12.

It is to be understood that the present invention is not limited to the embodiment described above, but encompasses any and all embodiments within the scope of the following claims.

I claim:

1. A coaxial cable end connector for being crimped by axial compression and for use with a coaxial cable having a central conductor, an inner insulation, an outer conductor, and an outer insulation, the coaxial cable end connector comprising:

an outer barrel having a bore, a longitudinal axis, and a wall, said wall of said outer barrel having at least one collapsible band extending between a first non-collapsible wall portion and a second non-collapsible wall portion, said collapsible band having an inner side facing toward the longitudinal axis of said outer barrel, said collapsible band having an outer side facing away from the longitudinal axis of said outer barrel, said collapsible band having a bend about midway between said first non-collapsible wall portion and said second non-collapsible wall portion when viewed in cross section, said outer side of said collapsible band having a first portion extending between said bend and said first non-collapsible wall portion, said outer side of said collapsible band having a second portion extending between said bend and said second non-collapsible wall portion, said first portion of said outer side of said collapsible band and said second portion of said outer side of said collapsible band forming an obtuse angle therebetween, said inner side of said collapsible band having a first portion extending between said bend and said first non-collapsible wall portion, said inner side of said collapsible band having a second portion extending between said bend and said second non-collapsible wall portion, said first portion of said inner side of said collapsible band and said second portion of said inner side of said collapsible band forming an obtuse angle therebetween, such that said bend is positioned radially closer to the longitudinal axis of said outer barrel than any other portion of said collapsible band when said collapsible band is viewed in cross section and prior to axial compression of said outer barrel, and an inner tube positioned at least in part within the bore of said outer barrel, said inner tube being coaxial with said outer barrel, said collapsible band forming an annular rib projecting inward toward said inner tube when said outer barrel is axially compressed, to thereby fixedly grip the outer conductor and the outer insulation of the coaxial cable between said outer barrel and said inner tube, and simultaneously frictionally fix said inner tube to the coaxial cable and relative to said outer barrel, when the coaxial cable is inserted into said outer barrel, such that the central conductor and the inner insulation are inserted into said inner tube and the outer conductor and the outer insulation are positioned intermediate said outer barrel and said inner tube, prior to compression of said outer barrel.

2. The coaxial cable end connector according to claim 1, wherein, at least a portion of said first non-collapsible wall portion has a first inner radius and at least a portion of said second non-collapsible wall portion has a second inner radius, said first inner radius of said first non-collapsible wall portion being equal to said second inner radius of said second non-collapsible wall portion, the inner side of said collapsible band meets said first non-collapsible wall portion at a location spaced radially farther from the longitudinal axis of said outer barrel than said first inner radius of said first non-collapsible wall portion, and the inner side of said collapsible band meets said second non-collapsible wall portion at a location spaced radially farther from the longitudinal axis of said outer barrel than said second inner radius of said second non-collapsible wall portion, such that the inner side of said collapsible band does not project radially inward to a distance closer to the longitudinal axis of said outer barrel than said first inner radius of said first non-collapsible wall portion prior to said outer barrel being axially compressed.

3. The coaxial cable end connector according to claim 2, wherein said first non-collapsible wall portion has a first inner surface, and said second non-collapsible wall portion has a second inner surface, said first inner surface meeting said inner side of said collapsible band at a third inner radius which is greater than said first inner radius, said second inner surface meeting said inner side of said collapsible band at a fourth inner radius which is greater than said second inner radius, said first inner surface extending from said inner side of said collapsible band to said at least a portion of said first non-collapsible wall portion having said first inner radius, along a first radius of curvature so as to form a first undercut surface adjacent said collapsible band when said collapsible band is viewed in cross section prior to axial compression of said outer barrel, said second inner surface extending from said inner side of said collapsible band to said at least a portion of said second non-collapsible wall portion having said second inner radius, along a second radius of curvature so as to form a second undercut surface adjacent said collapsible band when said collapsible band is viewed in cross section prior to axial compression of said outer barrel, whereby said first and second undercut surfaces allow said collapsible band to collapse without cracking when said collapsible band is fully collapsed.

4. The coaxial cable end connector according to claim 2, wherein the inner side of said collapsible band extends from either side of the bend in said collapsible band to a greater extent than the outer side of said collapsible band.

5. The coaxial cable end connector according to claim 4, wherein said first non-collapsible wall portion has a first inner surface, and said second non-collapsible wall portion has a second inner surface, said first inner surface meeting said inner side of said collapsible band at a third inner radius which is greater than said first inner radius, said second inner surface meeting said inner side of said collapsible band at a fourth inner radius which is greater than said second inner radius, said first inner surface extending from said inner side of said collapsible band to said at least a portion of said first non-collapsible wall portion having said first inner radius, along a first radius of curvature so as to form a first undercut surface adjacent said collapsible band when said collapsible band is viewed in cross section prior to axial compression of said outer barrel, said second inner surface extending from said inner side of said collapsible band to said at least a portion of said second non-collapsible wall portion having said second inner radius, along a second radius of curvature so as to form a second undercut surface adjacent said collapsible band when said collapsible band is viewed in cross section prior to axial compression of said outer barrel, whereby said first and second undercut surfaces allow said collapsible band to collapse without cracking when said collapsible band is fully collapsed.

6. The coaxial cable end connector according to claim 4, wherein said outer side of said collapsible band extends on either side of said bend for a first extent, and said inner side of said collapsible band essentially parallels said outer side of said collapsible band at least over said first extent.

7. The coaxial cable end connector according to claim 2, wherein said first non-collapsible wall portion has a large exterior diameter portion and a small exterior diameter portion, the small exterior diameter portion being located distally from said collapsible band and terminating in an open end, said small exterior diameter portion having a first outer radius, further, said inner tube having an inlet end and an outlet end located outside the bore of said outer barrel proximate the open end of said small exterior diameter portion, said first non-collapsible wall portion having an intermediate portion intermediate said small exterior diameter portion and said large exterior diameter portion, said intermediate portion having a second outer radius that is greater than said first outer radius, the coaxial cable end connector further comprising:

a first flange projecting radially outward from said outlet end of said inner tube and abutting said open end of said first non-collapsible wall portion, said first flange having a third outer radius; and a female receptacle having internal threads that are matingly engageable with the male external threads on a male coaxial cable end connector, said female receptacle further having a second flange which projects radially inward and has an inner radius smaller than said second outer radius and said third outer radius, said second flange being positioned intermediate said first flange and said intermediate portion of said first non-collapsible wall portion to thereby retain said female receptacle as part of the coaxial cable end connector while allowing said female receptacle to rotate freely relative to said outer barrel and said inner tube.

8. The coaxial cable end connector according to claim 7, wherein said female receptacle has an internal o-ring groove formed therein intermediate said internal threads and said second flange, said o-ring groove being spaced apart from said second flange so as to be positioned on a side of said first flange opposite a side of said first flange adjacent said second flange, the coaxial cable end connector further comprising:

a first o-ring positioned within said o-ring groove; and a second o-ring positioned around said small exterior diameter portion of said first non-collapsible wall portion and intermediate said second flange and said intermediate portion of said first non-collapsible wall portion, to thereby seal the coaxial cable end connector from corrosive agents in an ambient environment in which the coaxial cable end connector is used after attachment to the end of a coaxial cable and mating engagement to a male coaxial cable end connector.

9. The coaxial cable end connector according to claim 7, wherein said collapsible band is a first collapsible band, the coaxial cable end connector further comprising:

a third non-collapsible wall portion; and a second collapsible band extending between said third non-collapsible wall portion and said second non-collapsible wall portion to thereby provide greater gripping force between the coaxial cable end connector and an end of a coaxial cable.

10. The coaxial cable end connector according to claim 7, wherein said female receptacle has hexagonal exterior facets that allow said female receptacle to be turned by a wrench.

11. The coaxial cable end connector according to claim 1, wherein said outer side of said collapsible band extends on either side of said bend for a first extent, said inner side of said collapsible band extending on either side of said bend for a second extent which is greater than said first extent, and said inner side of said collapsible band essentially parallels said outer side of said collapsible band at least over said first extent.

12. The coaxial cable end connector according to claim 1, wherein said first non-collapsible wall portion has a large exterior diameter portion and a small exterior diameter portion, the small exterior diameter portion being located distally from said collapsible band and terminating in an open end, said small exterior diameter portion having a first outer radius, further, said inner tube having an inlet end and an outlet end located outside the bore of said outer barrel proximate the open end of said small exterior diameter portion, said first non-collapsible wall portion having an intermediate portion intermediate said small exterior diameter portion and said large exterior diameter portion, said intermediate portion having a second outer radius that is greater than said first outer radius, the coaxial cable end connector further comprising:

a first flange projecting radially outward from said outlet end of said inner tube and abutting said open end of said first non-collapsible wall portion, said first flange having a third outer radius; and a female receptacle having internal threads that are matingly engageable with the male external threads on a male coaxial cable end connector, said female receptacle further having a second flange which projects radially inward and has an inner radius smaller than said second outer radius and said third outer radius, said second flange being positioned intermediate said first flange and said intermediate portion of said first non-collapsible wall portion to thereby retain said female receptacle as part of the coaxial cable end connector while allowing said female receptacle to rotate freely relative to said outer barrel and said inner tube.

13. The coaxial cable end connector according to claim 12, wherein said female receptacle has an internal o-ring groove formed therein intermediate said internal threads and said second flange, said o-ring groove being spaced apart from said second flange so as to be positioned on a side of said first flange opposite a side of said first flange adjacent said second flange, the coaxial cable end connector further comprising:

a first o-ring positioned within said o-ring groove; and a second o-ring positioned around said small exterior diameter portion of said first non-collapsible wall portion and intermediate said second flange and said intermediate portion of said first non-collapsible wall portion, to thereby seal the coaxial cable end connector from corrosive agents in an ambient environment in which the coaxial cable end connector is used after attachment to the end of a coaxial cable and mating engagement to a male coaxial cable end connector.

14. The coaxial cable end connector according to claim 12, wherein said collapsible band is a first collapsible band, the coaxial cable end connector further comprising:

a third non-collapsible wall portion; and a second collapsible band extending between said third non-collapsible wall portion and said second non-collapsible wall portion to thereby provide greater gripping force between the coaxial cable end connector and an end of a coaxial cable.

15. The coaxial cable end connector according to claim 12, wherein said female receptacle has hexagonal exterior facets that allow said female receptacle to be turned by a wrench.

* * * * *